US006715757B1

(12) United States Patent
Snyder

(10) Patent No.: US 6,715,757 B1
(45) Date of Patent: Apr. 6, 2004

(54) COIN TRANSFER DEVICE FOR SLOT MACHINE COIN TRAYS

(76) Inventor: Gerald E Snyder, 832 N. 675 East Rd., Palmer, IL (US) 62556

( * ) Notice: Subject to any disclaimer, the term of this patent is extended or adjusted under 35 U.S.C. 154(b) by 0 days.

(21) Appl. No.: 10/304,101

(22) Filed: Nov. 25, 2002

(51) Int. Cl.[7] ..... A63B 71/00

(52) U.S. Cl. ..... 273/148 R; 273/143 R; 463/20; 463/46

(58) Field of Search ..... 273/143 R, 148 R, 273/138.2; 463/20, 46

(56) References Cited

U.S. PATENT DOCUMENTS 5,429,362 A * 7/1995 Takemoto et al. ..... 273/143 R
5,715,928 A * 2/1998 Bradley ..... 194/344
6,530,690 B2 * 3/2003 Smith et al. ..... 383/12
2003/0032388 A1 * 2/2003 Rasmussen et al. ..... 453/63

* cited by examiner

*Primary Examiner*—Benjamin H. Layno
(74) *Attorney, Agent, or Firm*—Michael I Kroll

(57) ABSTRACT

The present invention 10 discloses a coin transfer device for slot machine coin trays wherein the bottom of the tray 20 has a sliding door 26 that covers a throughbore 36 passing therethrough when the door 26 is closed and exposes it when open in order to allow a user 14 to easily transfer any coins in the tray 20 into a coin cup 16 maintained in a cup receiving member 18 situated immediately below the throughbore 36. The sliding door 26 slides within oppositely disposed door guides 28 and has a stop 30 thereon. The door 26 also has a handle 32 thereon. A transportation tray 10 is also disclosed having multiple throughbores 42 therein for receiving cups 16 therein for transportation about a casino.

10 Claims, 11 Drawing Sheets

COIN TRANSFER DEVICE FOR SLOT MACHINE COIN TRAYS

BACKGROUND OF THE INVENTION

1. Field of the Invention

The present invention relates generally to slot machine coin trays and, more specifically, to a coin transfer device for slot machine coin trays wherein the bottom of the tray has a sliding door that covers a throughbore passing therethrough when the door is closed and exposes it when open in order to allow a user to easily transfer any coins in the tray into a coin cup maintained in a cup receiving member situated immediately below said throughbore.

Slot machines discharge coins into a coin tray from which they must be removed by hand and placed into a coin cup which can be somewhat cumbersome when there are more than a few coins contained therein. Furthermore, the degree of difficulty in transferring the coin increases dramatically when the person playing the slot machine is elderly or infirm, a population that happens to dominate the populace of casinos and other gaming establishments. The present invention seeks to alleviate the difficulty of transferring a multiplicity of coins from the coin tray to the cup.

2. Description of the Prior Art

Numerous coin transfer devices have been provided in prior art. While these devices may be suitable for the particular purpose to which they address, they would not be as suitable for the purposes of the present invention as heretofore described.

SUMMARY OF THE PRESENT INVENTION

The present invention discloses a coin transfer device for slot machine coin trays wherein the bottom of the tray has a sliding door that covers a throughbore passing therethrough when the door is closed and exposes it when open in order to allow a user to easily transfer any coins in the tray into a coin cup maintained in a cup receiving member situated immediately below the throughbore. The sliding door slides within oppositely disposed door guides and has a stop thereon. The door also has a handle thereon. A transportation tray is also disclosed having multiple throughbores therein for receiving cups therein for transportation about a casino.

A primary object of the present invention is to provide a coin transfer device for slot machine coin trays that will over come the shortcomings of the prior art devices.

Another object of the present invention is to provide a coin transfer device for slot machine coin trays that permits the user to transfer coins from the coin tray to the cup simply by sliding open a door located in the bottom of the tray to expose a throughbore.

Yet another object of the present invention is to provide a coin transfer device for slot machine trays having a cup-receiving member for holding the cup in position below the throughbore.

Still another object of the present invention is to provide a coin transfer device for slot machine trays that can be modified to hold plurality of coin cups.

Yet another object of the present invention is to provide a coin transfer device for slot machine trays that is economical in cost to manufacture and operate.

One more object of the present invention is to provide a coin transfer device for slot machine trays that is simple and easy to use.

Additional objects of the present invention will appear as the description proceeds.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
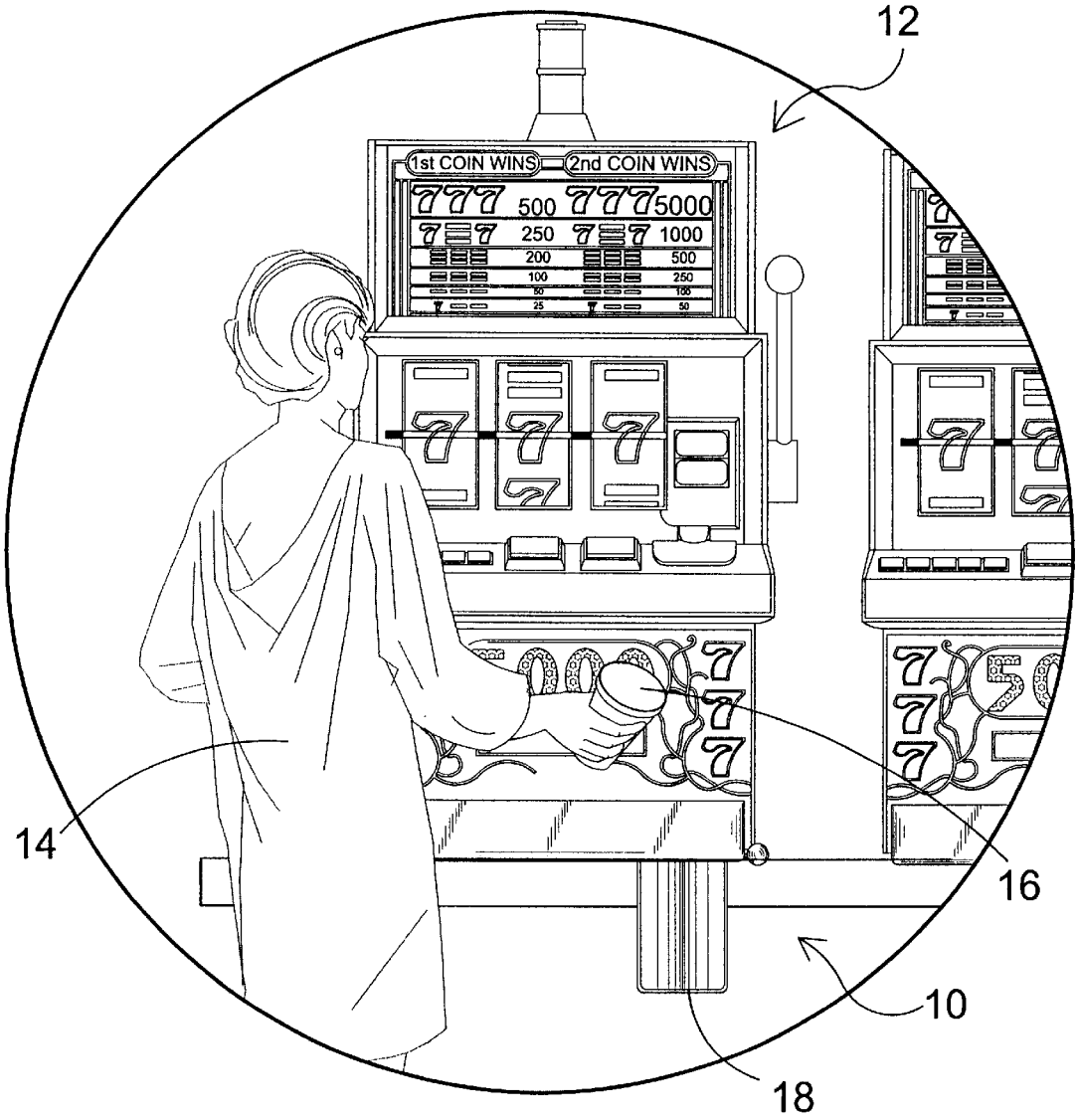
FIG. 1 is an illustrative view of the present invention in use.

With regard to reference numerals used, the following numbering is used throughout the drawings.

10 present invention
12 slot machine
14 user
16 cup
18 cup receiving member
20 coin tray
22 walls
24 bottom
26 sliding door
27 aperture for door
28 door guide
30 door stop
32 handle
34 bottom extension member
36 throughbore
38 cylindrical back
40 transportation tray
42 transportation tray throughbore
44 lip

DETAILED DESCRIPTION OF THE PREFERRED EMBODIMENTS

The following discussion describes in detail one embodiment of the invention and several variations of that embodiment. This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrated view of the present invention 10 in use. Shown is the present invention 10 installed on a slot machine 12 to aid the user 14 in the gathering and transporting of discharged coins from a slot machine. The present invention 10 provides a tray with a sliding door and cup receiving member that allows the user 14 to place a cup 16 in the cup receiving member 18 so that when the door is opened a throughbore in the coin tray bottom is revealed above the cup 16 so that the cup can be easily and quickly filled with the coins for transportation to another slot machine or to cash out.

Figure 2:
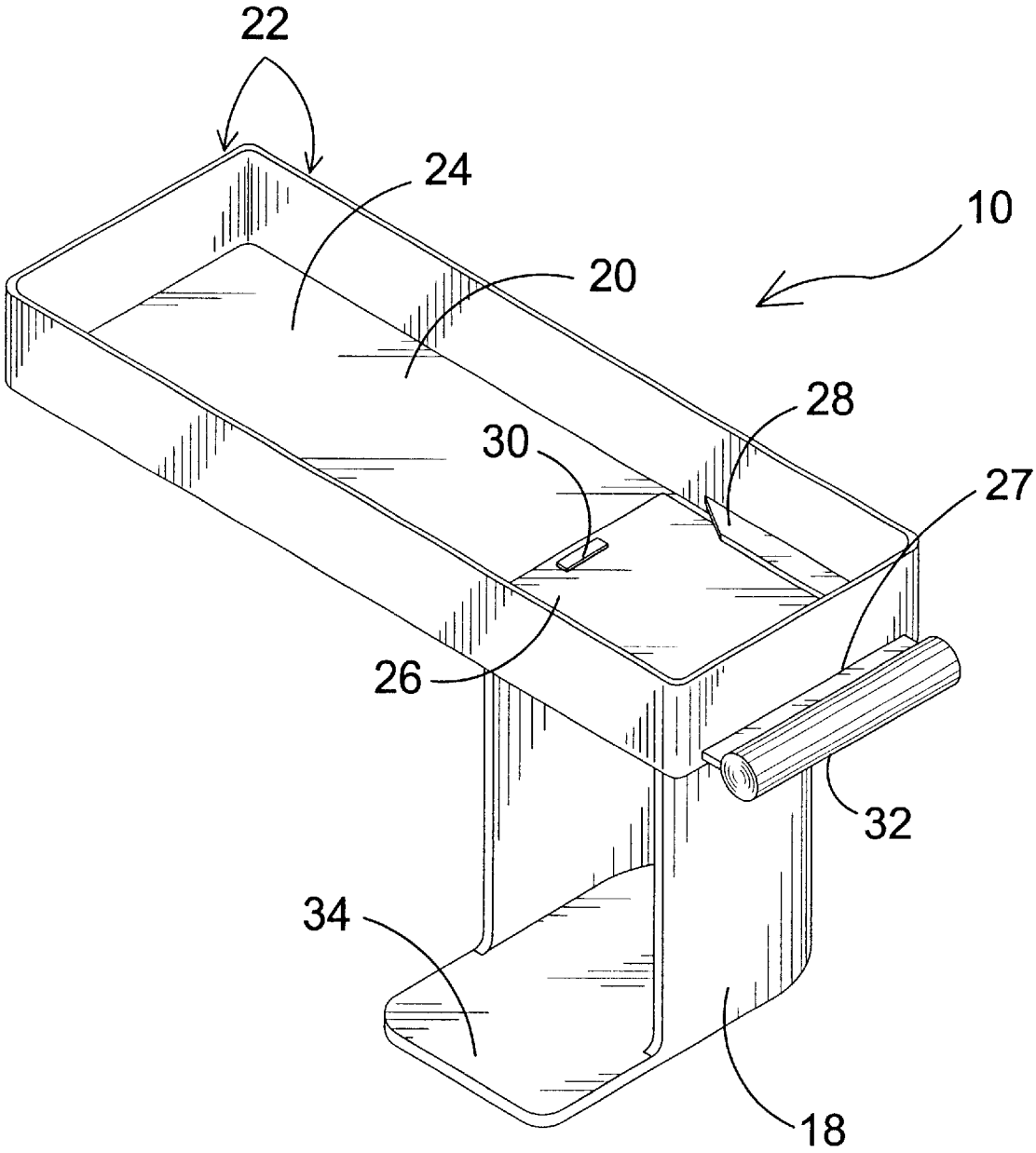
FIG. 2 is a perspective view of the present invention.

Turning to FIG. 2, shown therein is a perspective view of the present invention 10 showing a coin tray 20 with a typically rectangular planar bottom surface 24 having vertically extending wall portions 22 surrounding the periphery of the bottom surface to provide an area whereby coins discharged from a slot machine may be collected therein. Additionally shown incorporated into one end of the bottom surface 24 is a sliding door 26 that may be opened through an aperture 27 in the end wall to expose a throughbore disposed in the bottom surface that allows for the discharged coins to be collected into a cup which is placed into a downwardly extending cup receiving member 18. Also shown are a door guide 28, a door stop 30, an enlarged handle 32 being about the same width as the door 26 and a bottom extension member 34. The door guides 28 extend horizontally inward parallel to the bottom surface of the coin tray to permit the sliding door to operate therein.

Figure 3:
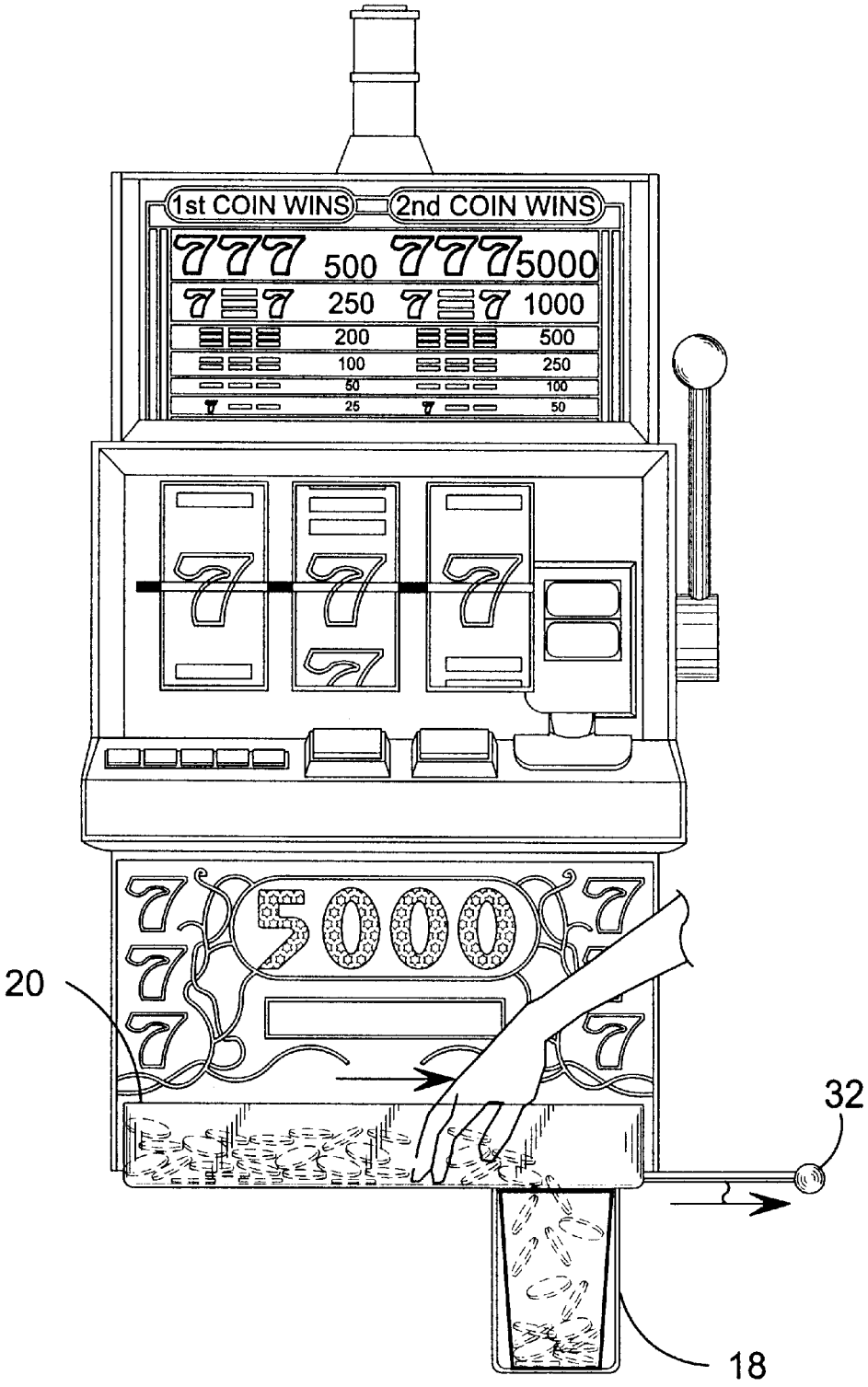
FIG. 3 is a front view of the present invention installed on a slot machine.

Turning to FIG. 3, shown therein is a front view of the present invention 10 showing the present invention having the form of a standard slot machine 12 coin tray having improvements upon the coin tray designed to aid the user by providing an area 18 where a cup can be accommodated and may he placed therein, that additionally allows for easier and more efficient filling of the cup when a large quantity of coins is within the coin tray 20 of the present invention. Also shown is a handle 32 on the present invention.

Figure 4:
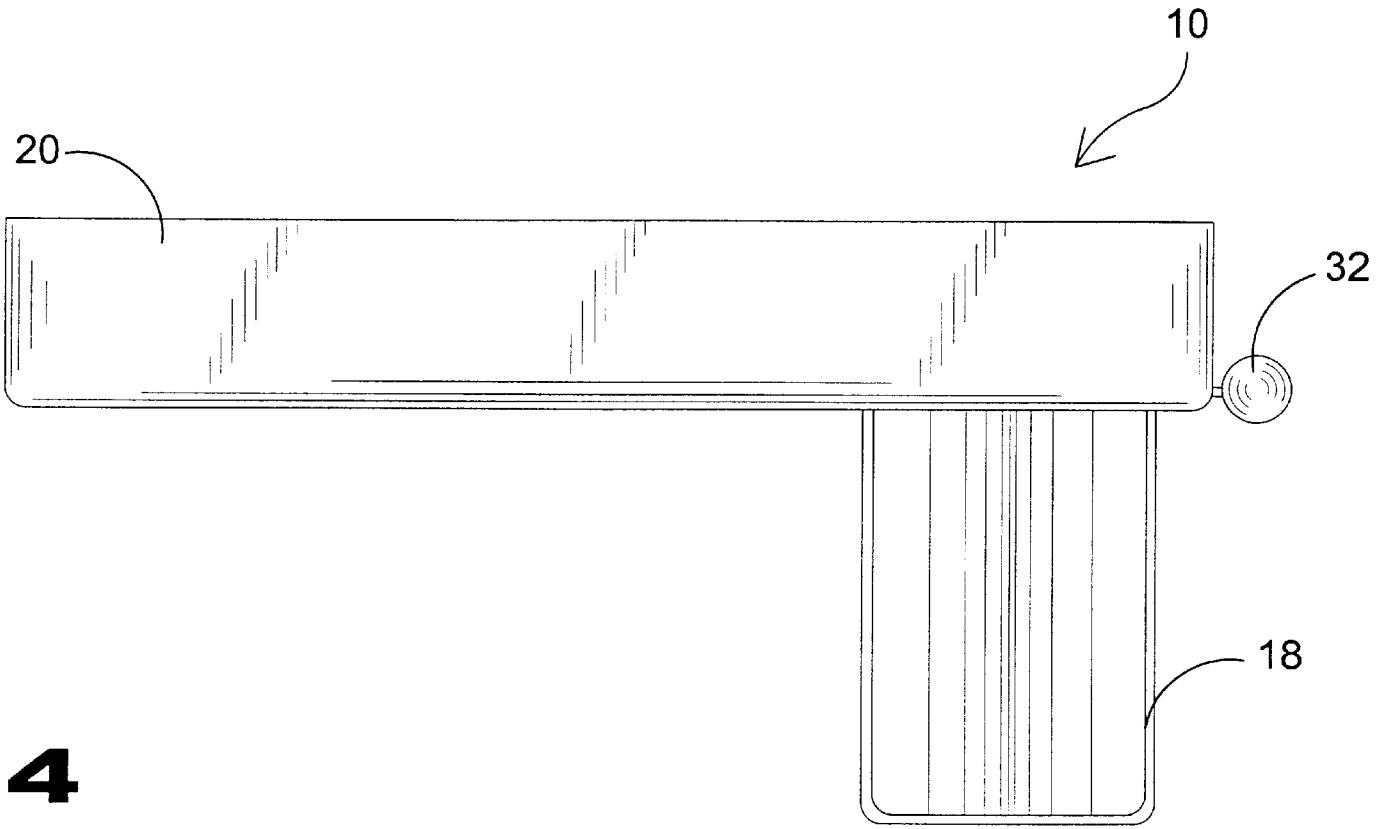
FIG. 4 is a front view of the present invention.

Turning to FIG. 4, shown therein is a front view of the present invention 10 showing the present invention having a cup-receiving member 18 with a form that hangs in an upright manner conveniently under the coin tray 20 that provides easy storage and placement for the cup until needed. Handle 32 is also shown.

Figure 5:
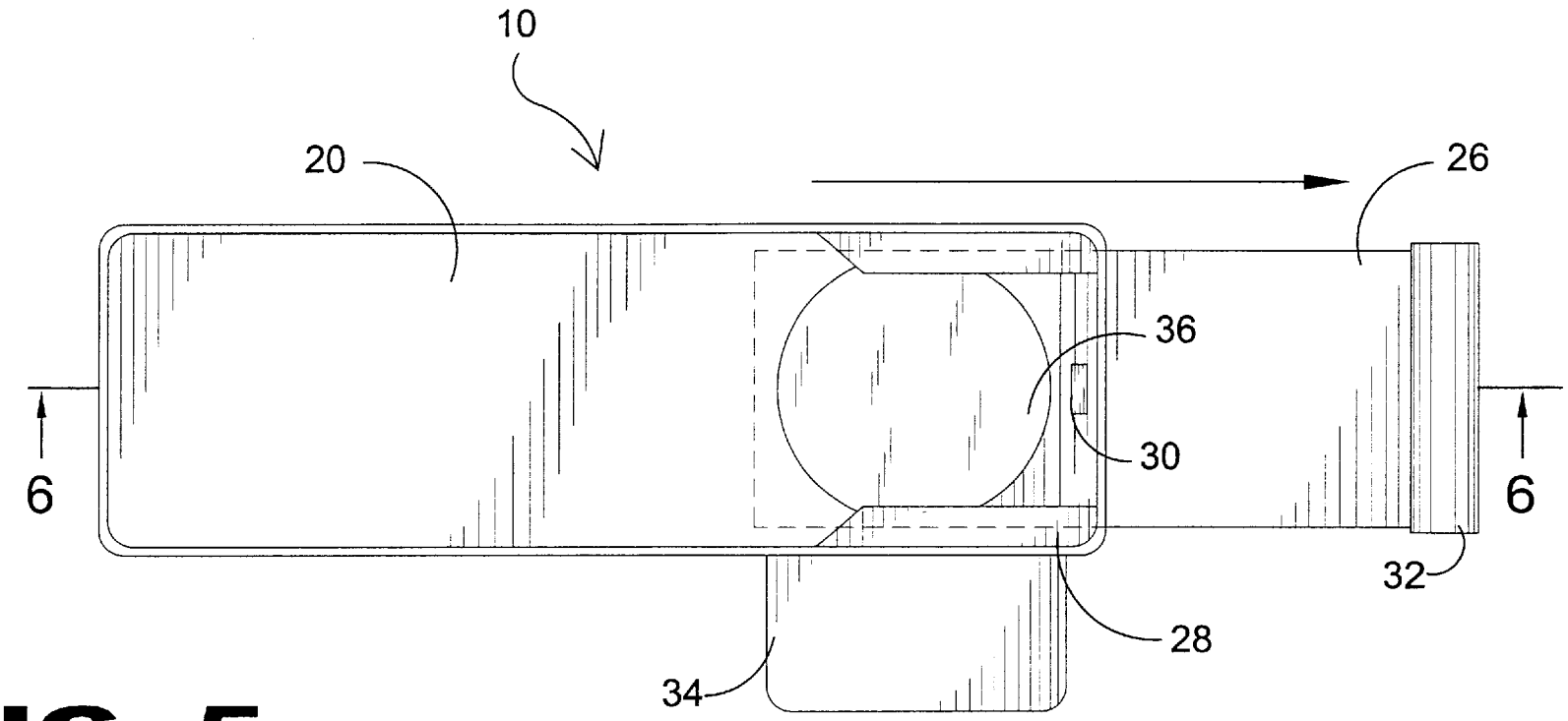
FIG. 5 is a top view of the present invention

Turning to FIG. 5, shown therein is a perspective view of the present invention 10 showing the present invention having a sliding door 26 with handle 32 having door guides 28 on each side to maintain correct placement, designed to be slide outward from the side of the coin tray 20 to reveal a throughbore 36 in the bottom surface of the coin tray for coin placement therethrough into a cup. Additionally, the size of the door 26 and throughbore may be modified in size or shape to accommodate different sized coins and cups. Also shown is a door stop 30 and bottom extension member 34. The door stop 30 contacts the inner surface of the end wall to prevent the door 26 from falling out of the door guides 28.

Figure 6:
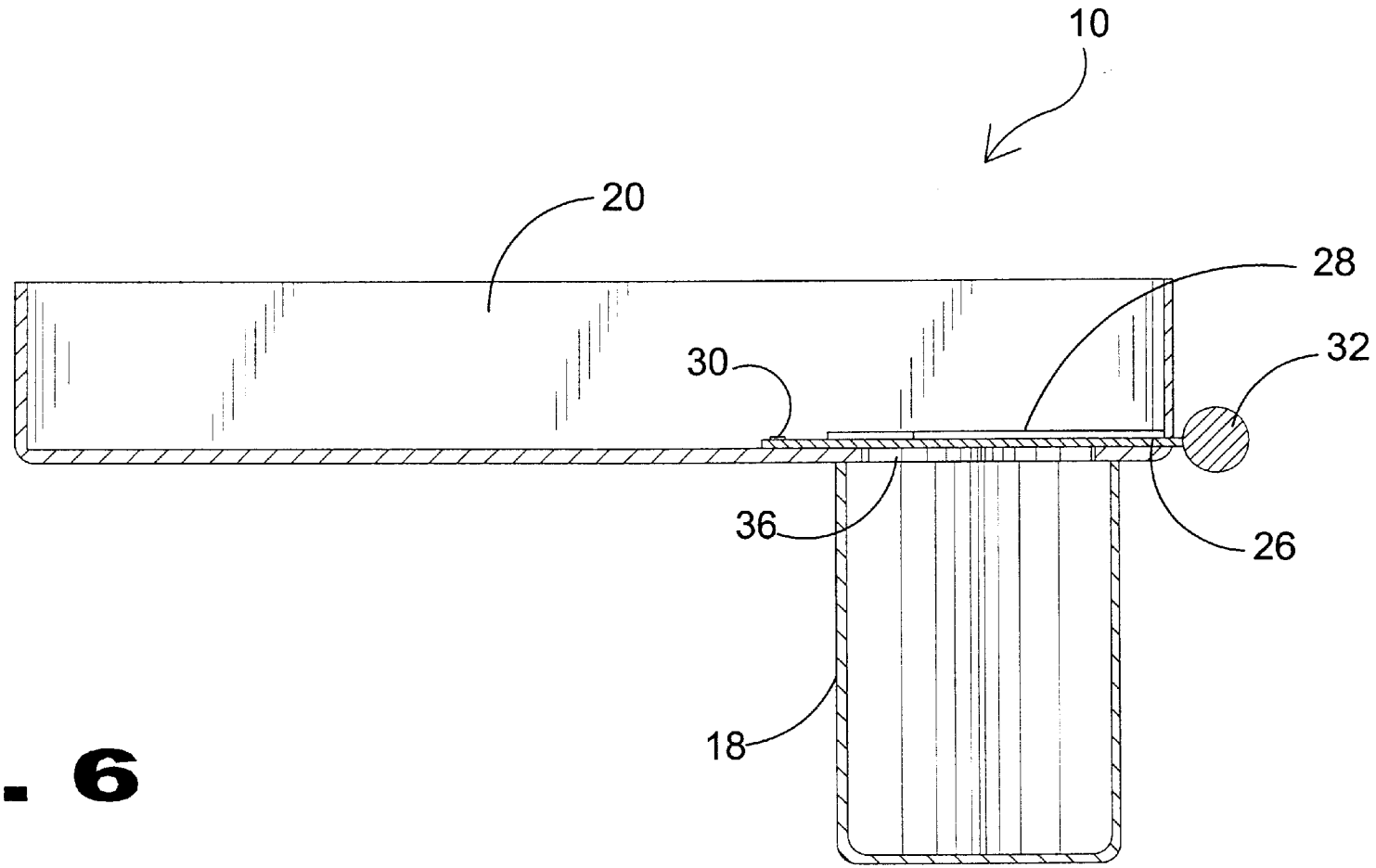
FIG. 6 is cross sectional front view of the present invention.

Turning to FIG. 6, shown therein is a cross sectional front view of the present invention 10. Shown is the present invention 10 having a sliding door 26 covering a throughbore 36 made in the structure of the coin tray 20 over the central portion of the cup receiving member 18 so that when a cup is placed in the cup receiving member coins that are displaced through the throughbore fall directly into the cup while the sliding door is in the open position. Additionally shown is the sliding door 26 having a door stop 30 being a small piece of upwardly protruding material that extends vertically from the end of sliding door opposite to the handle 32 end to prevent the sliding door from being pulled out and dislodged from the coin tray 20 and door guides 28.

Figure 7:
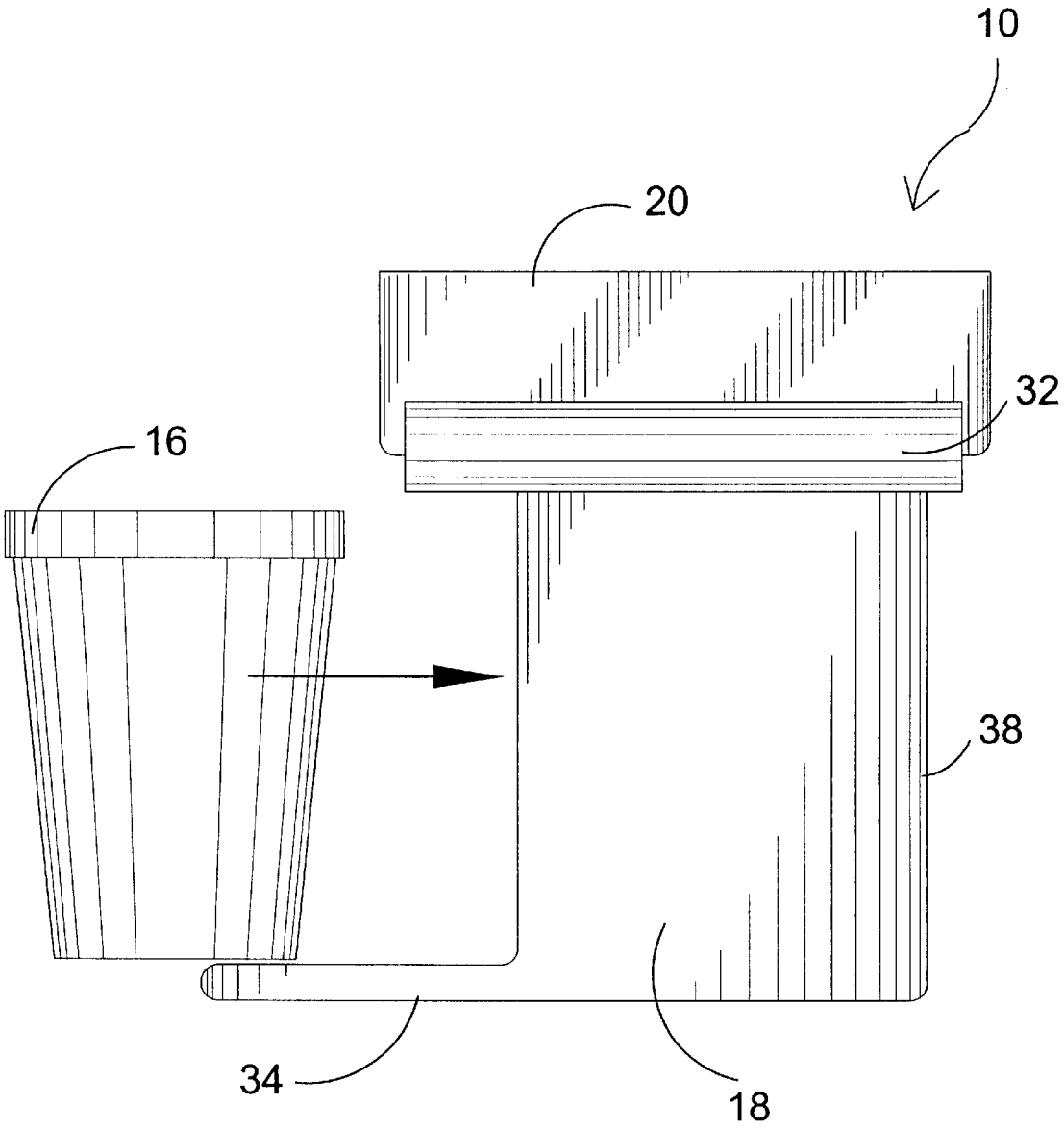
FIG. 7 is a side view of the present invention.

Turning to FIG. 7, shown therein is a side view of the present invention 10 showing a cup receiving member 18 that extends downward from the coin tray 20 having a cylindrical back portion 38 that extends forward to the forward edge of the coin tray provided for the easy placement of a cup 16 therein. Additionally shown is the coin tray 20 having a bottom extension member 34 used as a shelf or an area that the cup 16 may be placed on then slid into the said cup-receiving member 18.

Figure 8:
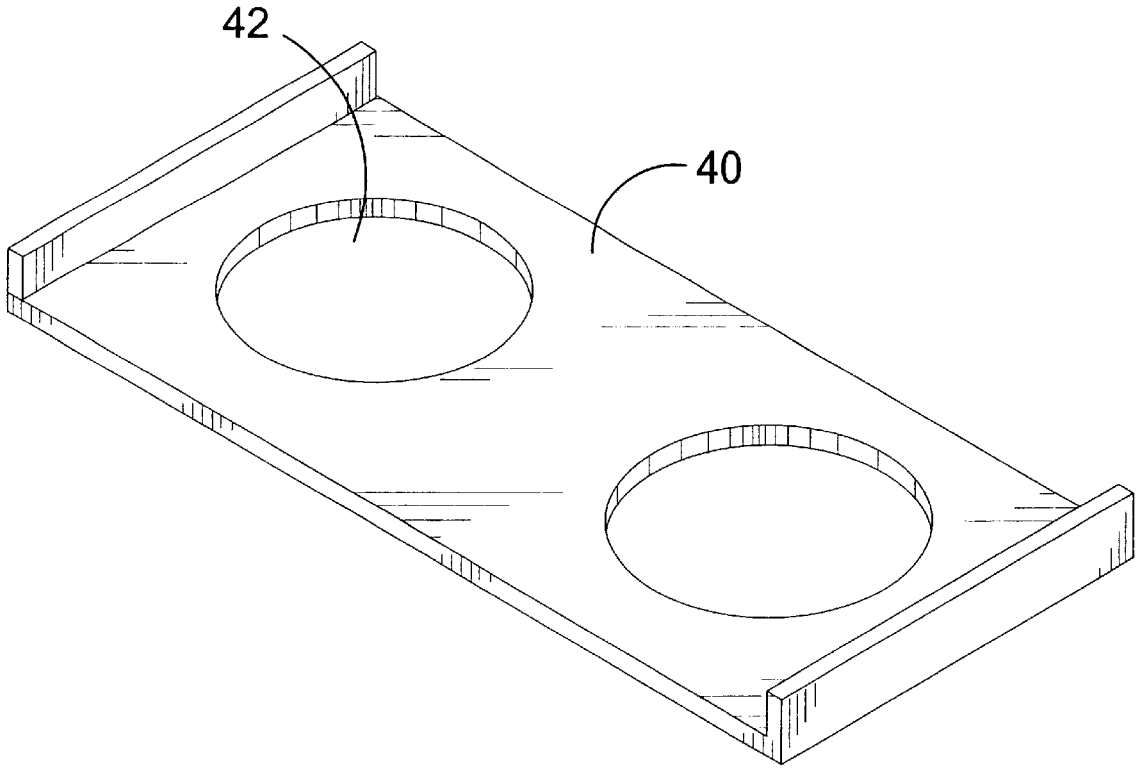
FIG. 8 is a perspective view of an additional element of the present invention.

Turning to FIG. 8, shown therein is a perspective view of an additional element of the present invention showing the transportation tray 40 of the present invention being a tray of typically rectangular form and planar configuration having a plurality of throughbores 42 therein so that multiple cups, e.g. 6", may be placed therein for easy transportation to another slot machine or to cash out.

Figure 9:
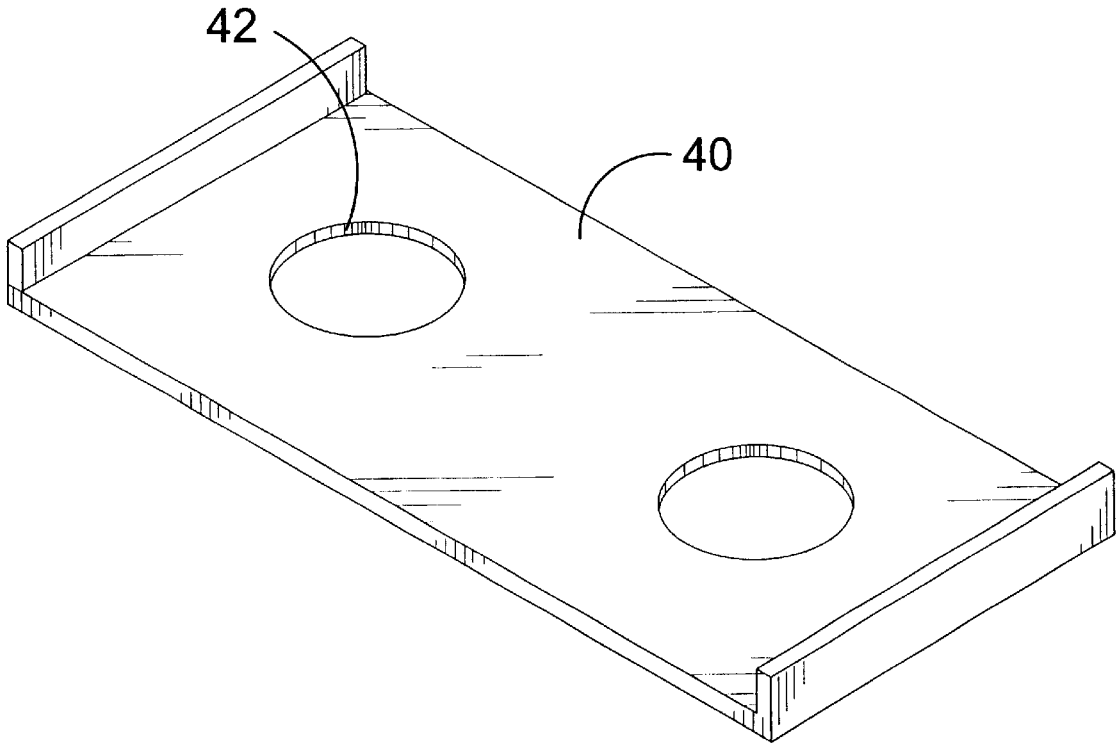
FIG. 9 is a perspective view of an additional element of the present invention.

Turning to FIG. 9, shown therein is a perspective view of an additional element of the present invention showing the transportation tray 40 of the present invention being a tray of typically rectangular form and planar configuration having a plurality of relatively smaller throughbores 42 that multiple cups, e.g. 4", may be placed therein for easy transportation to another slot machine or to cash out.

Figure 10:
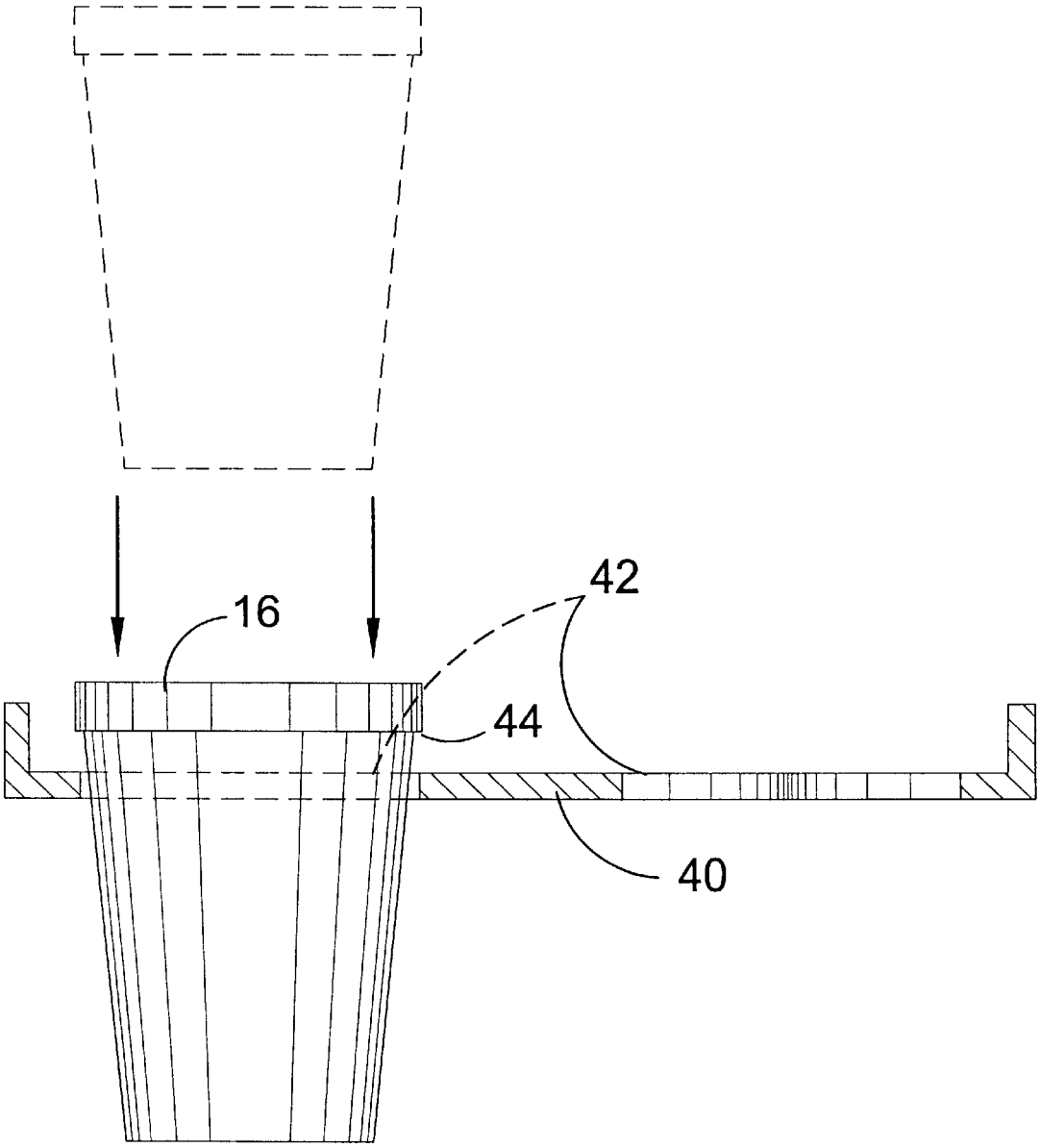
FIG. 10 is a cross sectional view of an additional element of the present invention.

Turning to FIG. 10, shown therein is a cross sectional view of an additional element of the present invention showing the transportation tray 40 of the present invention having a plurality of throughbores 42 with a cup 16 being inserted into one of them whereby the top surface of the tray throughbore engages the cups structure either by a progressively enlarging diameter of the cup or a lip 44 on the cup 16 that prevents the cup from further progression through the throughbore 42.

Figure 11:
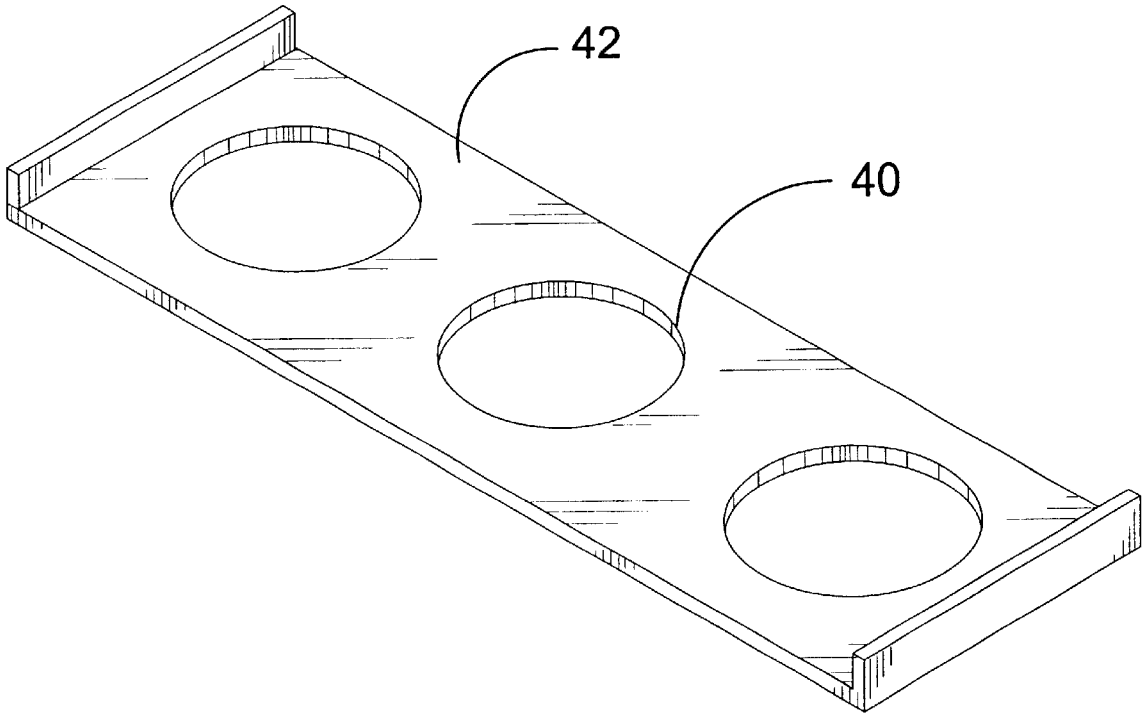
FIG. 11 is a perspective view of an additional element of the present invention.

Turning to FIG. 11, shown therein is a perspective view of an additional element of the present invention showing the transportation tray 40 of the present invention having a plurality of throughbores 42 with a cup being inserted into one of them whereby the throughbore engages the cups structure either by a progressively enlarging diameter of the cup or a lip on the cup that prevents the cup from further progression through the throughbore.

What is claimed to be new and desired to be protected by Letters Patent is set forth in the appended claims.

I claim:

1. A coin tray for use on a conventional slot machine, the coin tray adapted to transfer coins to a cup, comprising:

a) a coin tray being substantially planar, said coin tray being substantially rectangular shaped, said coin tray having upright walls disposed about the periphery of the coin tray, said coin tray having a bottom surface, a first and second end, and a front and a rear, said bottom surface having a throughbore therein, said throughbore being disposed adjacent said first end of said bottom surface, said wall of said first end having an aperture therein, said aperture for receiving a sliding door, said walls of said first end having an inner surface thereon for receiving a pair of door guides;

b) a sliding door disposed over said throughbore and extending through said aperture to permit the throughbore to be covered, said sliding door having a first end and a second end;

c) a pair of door guides disposed on said inner surface of said wall of said first end of said coin tray so as to guide the sliding door;

d) a handle disposed on said first end of said sliding door to permit the user to grasp the sliding door and operate the door;

e) a door stop disposed on said second end of said sliding door to prevent the door from falling out of the door guides;

f) a downwardly extending cup receiving member disposed on the bottom of said coin tray to permit a cup to be placed therein so that the cup can receive coins from the coin tray, said cup receiving member having a lower end; and, g) a cup for placement in said cup receiving member to permit the user to place coins in the cup; and, h) a slot machine for receiving the coin tray in the conventional location.

2. The coin tray of claim 1, wherein said door guides extend horizontally inwardly parallel to said bottom surface of said coin tray to permit the sliding door to operate.

3. The coin tray of claim 2, wherein said handle is enlarged and of about the same width as the sliding door.

4. The coin tray of claim 3, wherein said door stop is an upwardly extending protrusion which contacts the inner surface of the end wall of the first end of the coin tray to prevent the sliding door from falling out of the door guides.

5. The coin tray of claim 4, wherein said cup receiving member has a cylindrically shaped rear wall and a bottom disposed on said lower end of said cup receiving member to permit a cup to rest on the bottom.

6. The coin tray of claim 5, further comprising a bottom extension member disposed on said bottom of said cup receiving member to permit the bottom extension member to serve as a shelf for placement of a cup thereon and then to assist in placement of a cup in the cup receiving member.

7. The coin tray of claim 6, further comprising a cup transportation tray, said cup transportation tray being a substantially planar, said tray being a substantially rectangular tray, said tray having at least one throughbore therein, said throughbore for receiving a cup therein, said cup transportation tray having a top surface.

8. The cup transportation tray of claim 7, wherein said throughbore of said cup transportation tray is about six inches in diameter.

9. The cup transportation tray of claim 8, wherein said throughbore of said cup transportation tray is about four inches in diameter.

10. The cup transportation tray of claim 9, wherein said throughbore is complementarily sized so that said top surface of said cup transportation tray contacts a lip on a cup to prevent a cup from passing through the throughbore of the cup transportation tray.

* * * * *